US008919098B2

(12) United States Patent
Barucchi et al.

(10) Patent No.: US 8,919,098 B2
(45) Date of Patent: Dec. 30, 2014

(54) SYSTEM AND METHOD FOR REGENERATING THE PARTICULATE FILTER IN A DIESEL ENGINE

(71) Applicants: Fiat Powertrain Technologies S.p.A., Turin (IT); FPT Industrial S.p.A., Turin (IT)

(72) Inventors: Enrico Barucchi, Turin (IT); Giovanni Cerciello, Turin (IT); Danilo Garombo, Turin (IT); Paola Baratta, Turin (IT); Bruno Aimar, Turin (IT)

(73) Assignees: Fiat Powertrain Technologies S.p.A., Turin (IT); FPT Industrial S.p.A., Turin (IT)

( * ) Notice: Subject to any disclaimer, the term of this patent is extended or adjusted under 35 U.S.C. 154(b) by 41 days.

(21) Appl. No.: 13/690,441

(22) Filed: Nov. 30, 2012

(65) Prior Publication Data

US 2013/0167507 A1 Jul. 4, 2013

(30) Foreign Application Priority Data

Dec. 20, 2011 (EP) ..... 11194428

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |
| ***F01N 9/00*** | (2006.01) |
| ***F01N 11/00*** | (2006.01) |
| ***F02D 41/02*** | (2006.01) |
| *F02D 41/22* | (2006.01) |

(52) U.S. Cl.

CPC ..... *F01N 9/002* (2013.01); *F01N 11/00* (2013.01); *F02D 41/029* (2013.01); *F02D 2041/228* (2013.01); *F02D 2200/0812* (2013.01); *F02D 2250/11* (2013.01)

USPC ..... 60/277; 60/295; 60/297; 60/311; 60/274

(58) Field of Classification Search

USPC ..... 60/274, 277, 285, 286, 295, 297, 311

See application file for complete search history.

(56) References Cited

U.S. PATENT DOCUMENTS 6,865,884 B2 3/2005 Braun et al.
2007/0261389 A1* 11/2007 Colignon ..... 60/274

(Continued)

FOREIGN PATENT DOCUMENTS

EP 1584802 A2 10/2005
EP 1584806 A2 10/2005

(Continued)

OTHER PUBLICATIONS

Partial European Search Report, dated May 29, 2012, for corresponding EP Application No. 11194428.6.

(Continued)

*Primary Examiner* — Audrey K Bradley
*Assistant Examiner* — Dapinder Singh
(74) *Attorney, Agent, or Firm* — Heslin Rothenberg Farley & Mesiti P.C.; Victor A. Cardona, Esq.

(57) ABSTRACT

In a diesel engine equipped with a system for automatic regeneration of a particulate filter, an automatic regeneration mode is inhibited in the case where there is recorded a number higher than a pre-set threshold of unfavorable event. When the automatic regeneration mode is inhibited, an on-demand regeneration mode is simultaneously enabled, which can be activated manually by the driver. If an on-demand regeneration is not performed before the vehicle has covered a certain mileage since the automatic regeneration mode was inhibited, the vehicle is set in a condition of limited performance.

13 Claims, 4 Drawing Sheets

(56) References Cited

U.S. PATENT DOCUMENTS

| | | | | |
|---|---|---|---|---|
| 2008/0295491 | A1 | 12/2008 | Kuboshima et al. | |
| 2010/0089032 | A1 * | 4/2010 | Iwashita et al. | 60/274 |

FOREIGN PATENT DOCUMENTS

| | | | |
|---|---|---|---|
| EP | 1983165 | A1 | 10/2008 |
| EP | 2128392 | A1 | 12/2009 |
| FR | 2872213 | A1 | 12/2005 |
| FR | 2933735 | A1 | 1/2010 |

OTHER PUBLICATIONS

Extended European Search Report, dated Sep. 26, 2012, for corresponding EP Application No. 11194428.6.

* cited by examiner

SYSTEM AND METHOD FOR REGENERATING THE PARTICULATE FILTER IN A DIESEL ENGINE

CROSS-REFERENCE TO RELATED APPLICATIONS

This application claims priority to European Patent Application No. 11194428.6 filed on Dec. 20, 2011, the entire disclosure of which is incorporated herein by reference.

FIELD OF THE INVENTION

The present invention relates to diesel engines, and in particular to a system and a method for controlling regeneration of the particulate filter provided in the exhaust line of the engine.

PRIOR ART

The reduction of particulate emissions in the exhaust of a diesel engine constitutes a key problem for meeting current and future standards on pollutant emissions. For due observance of the limits of particulate emission it is necessary to make use of systems of treatment of exhaust gases, amongst which in particular a particulate filter or trap, which acts as mechanical barrier designed to prevent the passage of the particulate. The aforesaid trap is integrated in the exhaust line of the engine and is able to withhold inside it the particulate generated during the process of combustion, with an efficiency close to 100%. The accumulation of particulate on the filtering surface causes, however, an increase in the pressure at the exhaust of the engine, which determines a reduction in the engine efficiency. Consequently, there becomes periodically necessary a regeneration of the trap by means of combustion (light off) of the particulate accumulated inside it.

In order to activate the combustion of the particulate, without resorting to the use of chemical catalysts mixed to the fuel, the temperature of the burnt gases at the inlet of the trap must be brought to at least 600° C. over the entire operating range of the engine. In the majority of cases, the level of the temperature of the exhaust gases at the outlet of modern supercharged engines is far from the temperature of activation of the combustion of the particulate, so that it becomes necessary to increase the temperature of the exhaust gases until it reaches the value for light-off of the particulate. The solution to said problem, already currently in use, is based upon the extreme flexibility of control of the process of combustion that can be obtained with modern fuel-injection systems of the common-rail type, which are able to control multiple injections (higher than five in number) in one and the same engine cycle, as well as upon the presence of oxidizing catalytic devices set along the exhaust line of the engine.

FIG. 1 of the annexed drawings is a schematic illustration of the injection-control system and the exhaust system of a modern diesel engine. In said figure, the reference number 1 designates the engine, having a plurality of cylinders each provided with an electromagnetic fuel injector 2 controlled by an electronic control unit 3. The reference number 4 designates the air-intake pipe, set in which are a flowmeter 5, a throttle valve 6, an exhaust-gas recirculation (EGR) valve 7, and the supercharging compressor 8. The reference number 9 designates as a whole the exhaust line of the engine, set in which are the turbine 10, which is mechanically connected to the supercharging compressor 8, a precatalyser 11, the catalytic converter 12, and the particulate filter 13. The reference number 14 designates the line for exhaust-gas recirculation from the outlet of the engine to the EGR valve 7. A sensor 15 detects the difference in pressure existing between upstream and downstream of the system for treatment of the exhaust gases, constituted by the ensemble of the catalytic converter and the particulate filter. The electronic control unit 3 receives the signals at output from said sensor 15, from a temperature sensor 16 associated to the device for treatment of the exhaust gases, and from the flowmeter 5, and sends control signals to the throttle valve 6, to the EGR valve 7, and to the injectors 2. An oil-viscosity sensor 17 detects a quality of a lubricated oil of the engine.

Represented schematically in the upper part of FIG. 1 is a train of control pulses sent by the control unit to a single injector 2. As may be seen, in addition to the main pulse "MAIN" and to a pulse "PRE" that precedes the main pulse and a pulse "PILOT", the control unit is also able to send one or more delayed injection pulses "AFTER" and "POST".

The difference between the light-off temperature of oxidation of the particulate and that of the exhaust gases can be completely filled even in conditions of low load, by adequately calibrating the main engine parameters and using one or more injections of a "POST" type, with the purpose of enriching the flow of the gas of unburnt hydrocarbons that are converted by oxidizing catalysers set upstream of the particulate filter.

With reference to FIG. 1, the activation of an injection pulse of the type "AFTER", together with a modification of further parameters, amongst which timing of the injections of the "PILOT", "PRE" and "MAIN" types, injection pressure, amount of EGR, boost pressure, and position of the throttle valve, enables an increase in the temperature of the exhaust gases to be obtained immediately at output from the engine (at input to the turbine 10).

The activation of an injection pulse of the "POST" type enables an increase in the amount of hydrocarbons at the exhaust, with consequent raising of the temperature at output from the catalytic converter 12.

Thanks to said measures, the electronic control unit is hence able to activate an automatic mode of regeneration of the filter, temporarily bringing the temperature of the exhaust gases sent to the filter 13 to a value not lower than 600° C., so as to cause light-off of the particulate.

TECHNICAL PROBLEM

The presence of an injection of a "POST" type, i.e., an injection that is very much delayed with respect to the top dead centre of combustion (start of "POST" injection comprised, between 100° C. and 180° C. after top dead centre) is indispensable for proper operation of the regeneration strategy, but has contraindications linked to the problem of dilution of the engine lubricating oil. In fact, the considerable distance from the top dead centre of combustion that is characteristic of this type of injection causes the conditions of the charge of air introduced into the cylinder (pressure and temperature) at engine angles where the injection of a "POST" type is carried out to be unfavorable from the standpoint of penetration of the jet of fuel into the cylinder. Basically, in said conditions the aerodynamic resistance offered by the load and the thermal exchanges between the latter and the liquid jet of fuel sprayed out of the injector are not sufficient to prevent part of the fuel injected with the injection of a "POST" type from reaching the film of oil on the wall of the cylinder. The droplets of fuel, following upon contact with the film of lubricating oil, are englobed within the film, given also the perfect mixability between the two liquids. At each engine cycle, the film of lubricant contaminated by the diesel oil is brought back into the oil sump by one of the piston rings mounted around the piston (the so-called "oil-scraper" ring).

/What has just been described is not the only way in which the diesel oil can come into contact with the engine lubricating oil. In fact, on account of the blow-by flow, a part of the gas within the cylinder, containing a high percentage of unburnt hydrocarbons, leaks through the piston rings directly into the oil sump. Obviously, the level of and rate at which the two liquids interact is a function of the running conditions of the engine and of the conditions of use of the vehicle.

Exposure of the lubricating oil to the diesel oil injected into the cylinder determines a dilution of the lubricating oil, which can be expressed as weight percentage of fuel present in the solution, which causes an alteration of the lubricating properties of the oil. The contamination of the oil by fuel gives rise to a reduction in the kinematic viscosity, which represents the main parameter for assessing the quality of the oil. A reduction in the viscosity in the region of 30% renders necessary replacement of the oil, since the lubricating liquid is no longer able to perform its main functions (reduction of friction, protection of the mechanical members against wear, dissipation of heat).

The problem described above regarding dilution of the oil is present during the automatic step of regeneration of the particulate filter in any condition of operation of the engine, but assumes greater importance in conditions where the engine is running at low r.p.m. and low load, where the conditions inside the cylinder are the least favourable in terms of reduction of penetration of the let, and the amounts of fuel injected with the injection of a "POST" type necessary for reaching the light-off temperature of oxidation of the particulate are higher.

A further problem is constituted by the fact that in particular driving missions, for example of the so-called "door-to-door" type, i.e., for short stretches with frequent stopping and starting, the temperature of the particulate filter decreases during the stops so that upon subsequent restarting of the engine a warm-up is necessary, which lengthens the regeneration times and accentuates the problem of dilution of the oil, whilst at the same time the brevity of the stretch of the mission leads to an interruption of automatic regeneration before its completion.

OBJECT OF THE INVENTION

The object of the present invention is to provide a diesel engine equipped with a system for controlling regeneration of the particulate filter that will enable the drawbacks discussed above to be overcome.

A further object of the invention is to achieve the aforesaid aim with simple and low-cost means.

SUMMARY OF THE INVENTION

With a view to achieving the aforesaid objects, the subject of the invention is an engine according to claim 1 and a method according to claim 10. The engine according to the invention is characterized in the first place in that the electronic control unit is programmed for activating an alarm condition—inhibiting the aforesaid automatic regeneration mode and simultaneously enabling an on-demand regeneration mode that can be activated manually by the driver—when said electronic control unit detects the presence of at least one of the following two conditions;

exceeding of a pre-set threshold value of the number of unfavorable events i.e., of events in which the automatic-regeneration step is interrupted before its completion; and detection of a value lower than a pre-set threshold of a parameter identifying the quality of the engine lubricating oil.

The engine is provided with manual control means for activation of the aforesaid on-demand regeneration mode.

In the preferred embodiment of the invention, in the case of detection of a number of unfavorable events (premature interruptions of the automatic-regeneration step) higher than the threshold value, the automatic regeneration mode is inhibited only in the case where there is moreover detected a value of resistance to the flow of the exhaust gases through the particulate filter higher than a threshold value. Said resistance can in particular be detected on the basis of the difference in pressure between upstream and downstream of the particulate filter.

According to a further characteristic of the invention, in the case where the mode of automatic regeneration of the filter is inhibited for the reasons referred to above, the electronic control unit is programmed for controlling that a manual-regeneration procedure is executed within a certain distance travelled by the vehicle from when it is found in the alarm condition with the automatic regeneration mode inhibited. Preferably, the system is programmed with two successive mileage thresholds. When the first threshold is reached, a first alarm condition is activated and, when the second threshold is reached, a second alarm condition is activated; for example, the first alarm condition can envisage activation of a limitation of the performance of the vehicle such as to induce the driver to start the manual-regeneration strategy. When the second alarm condition is reached, a warning signal for engine breakdown can be generated, and the manual-regeneration procedure is no longer enabled for the driver, but can be enabled only at the repair shop.

In the preferred embodiment, activation of manual regeneration can be obtained by the driver only in the following, conditions:

vehicle stationary and brakes on;

engine functioning and in steady running conditions; and request for manual regeneration by the driver (by using the dedicated pushbutton or else by activating the accelerator pedal and brake pedal according to a pre-set modality).

Normally, the manual-regeneration procedure can have a duration in the region of 15 minutes. At the end of said procedure, automatic regeneration is again enabled and restarts with the step of accumulation of the particulate in the filter, with resetting of the counter of unfavorable events.

BRIEF DESCRIPTION OF THE DRAWINGS

Further characteristics and advantages of the invention will emerge from the ensuing description with reference to the annexed drawings, which are provided purely by way of non-limiting example and in which.

DESCRIPTION OF PREFERRED EMBODIMENT

Figure 1:
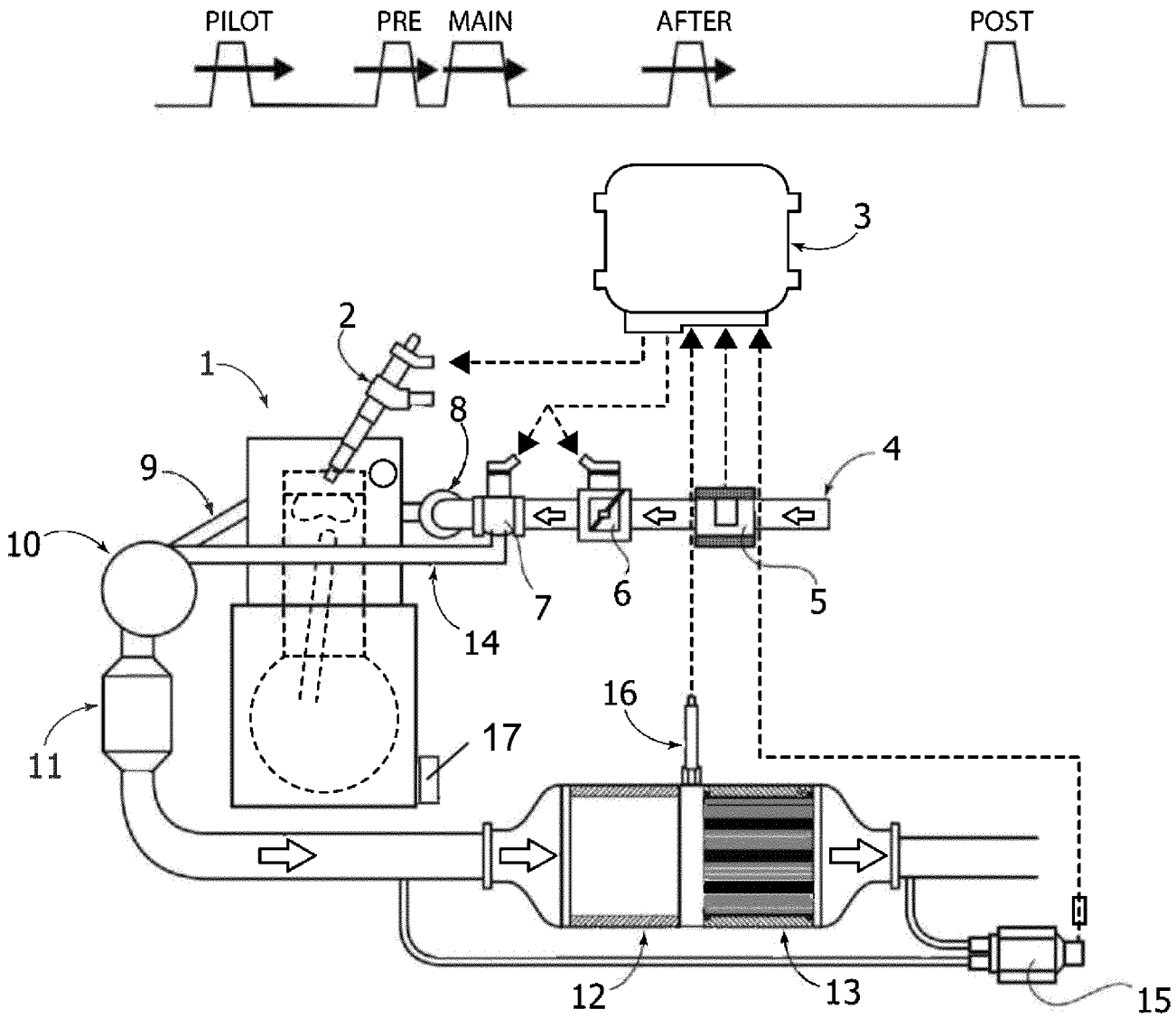
FIG. 1, already described above, is a schematic illustration of a diesel engine, of the type to which the control system according to the invention is applied.

With reference once again to FIG. 1, the engine according to the invention is provided, in a way similar to the prior art, with a system that activates automatic regeneration of the particulate filter when the amount of particulate accumulated in the filter exceeds a pre-set level. In the case of the invention, said amount is estimated with the use of models of the method of accumulation of the particulate in the filter that enable determination of the amount of said accumulation both during normal operation of the engine and at the end of the regeneration process. There basically exist two different models of estimation of the mass of particulate present in the filter: a model of a statistical type and a model of a physical type.

As discussed above, an engine equipped with just one system that activates automatic regeneration of the fitter when the amount of particulate accumulated in the filter exceeds a pre-set level is exposed to the risk of an excessive dilution of the engine lubricating oil on account of the injections of a "POST" type that are activated in the automatic-regeneration step, above all in the case where there occurs a long succession of unfavorable events, constituted by interruptions of the automatic-regeneration step before its completion, as occurs in the case of missions of the "door-to-door" type, i.e., short stretches with frequent stopping and restarting of the vehicle.

According to the invention, in order to prevent said problem, some critical conditions are identified in which the system generates an alarm condition, which can, for example, be signalled to the driver by turning-on of a warning light of the particulate filter ("DPF light"), inhibiting the automatic regeneration mode and enabling an on-demand regeneration mode that is activated by the driver, for example, by pressing a dedicated pushbutton or else by activating the accelerator pedal and brake pedal of the vehicle according to a pre-set modality.

Figure 2:
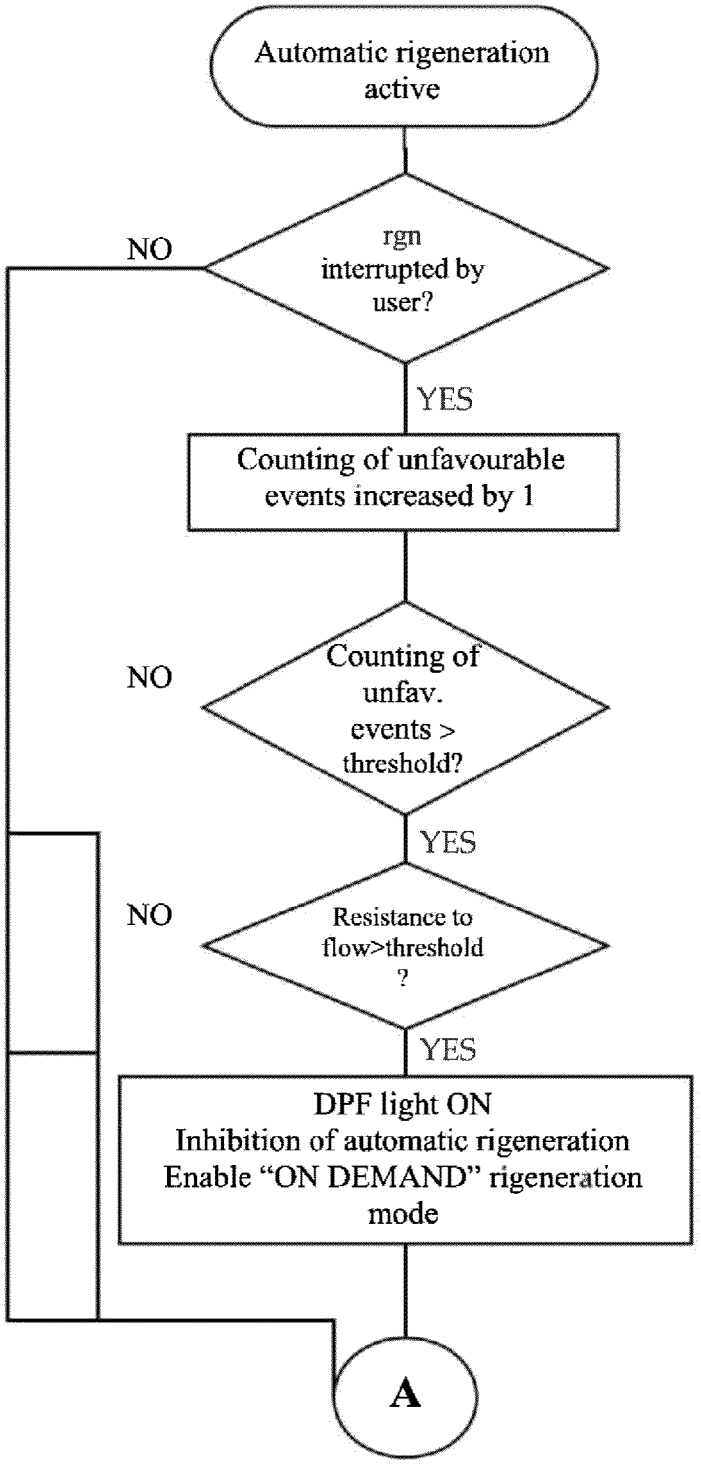
FIGS. 2-4 are flow charts that show the operating steps of the method implemented in the engine according to the invention.

FIG. 2 shows a first modality of activation of the alarm condition with inhibition of the automatic regeneration mode and enabling of the on-demand regeneration mode. According to said solution, there is provided a counter of unfavorable events that are constituted by an interruption of the automatic-regeneration step before its completion caused by the user (typically in so far as the vehicle is stopped and the engine is turned off). As illustrated in FIG. 2, in the case where the counter of unfavorable events detects a number of unfavorable events higher than a threshold number, the alarm condition is activated with the DPF light on, inhibition of the automatic DPF-regeneration mode, and enabling of the on-demand regeneration mode. However, as likewise illustrated in FIG. 2, preferably, once a number of unfavorable events higher than the threshold value is detected, the aforesaid alarm condition is activated only in the case where the system also detects a resistance to the flow of the exhaust gases caused by the particulate filter higher than a threshold. Said resistance can, for example, be measured on the basis of the value of the difference in pressure existing between upstream and downstream of the particulate filter.

Figure 3:
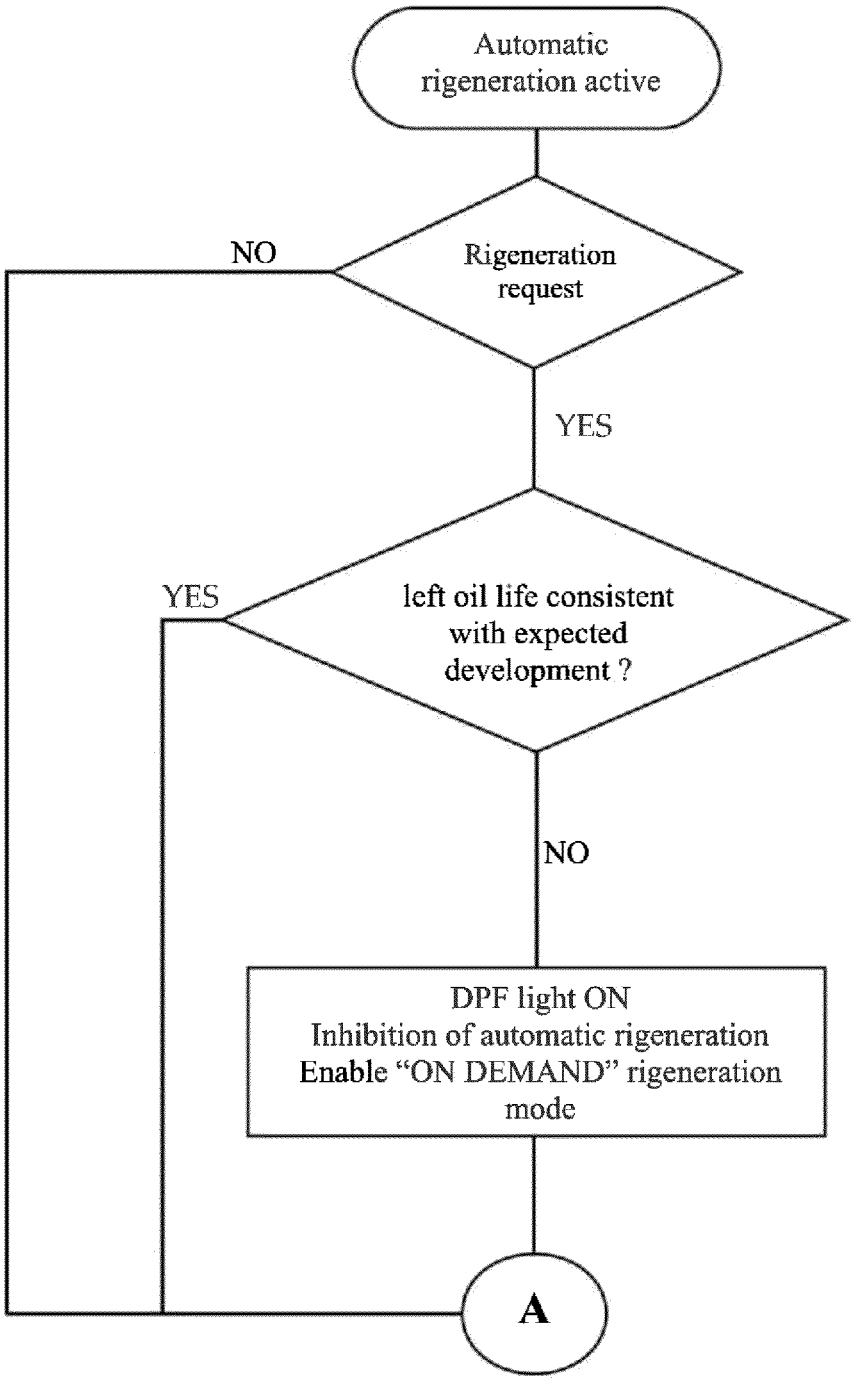

With reference to FIG. 3 as an alternative or in addition to the modality described above, the system can identify the critical condition that justifies inhibition of the automatic regeneration mode once a value of the quality of the engine lubricating oil judged insufficient is reached. In the case of the example illustrated in FIG. 3, in the case where the automatic regeneration mode is active and in the ease where automatic regeneration is required by the system (in so far as an excessive amount of particulate accumulated in the filter has been detected) the system enables automatic regeneration only in the case where it has verified that the quality of the lubricating oil is sufficient. The quality of the lubricating oil is monitored through a specific algorithm on the basis of a parameter identifying the quality of the oil, for example, the signal at output from an oil-viscosity sensor. In the case where the result of said algorithm is lower than a pre-set threshold reference value that would increase the frequency of engine-oil change to an unacceptable extent, the aforesaid alarm condition is again generated, with turning-on of the DPF light, inhibition of the automatic regeneration mode, and enabling of the on-demand regeneration mode.

Figure 4:
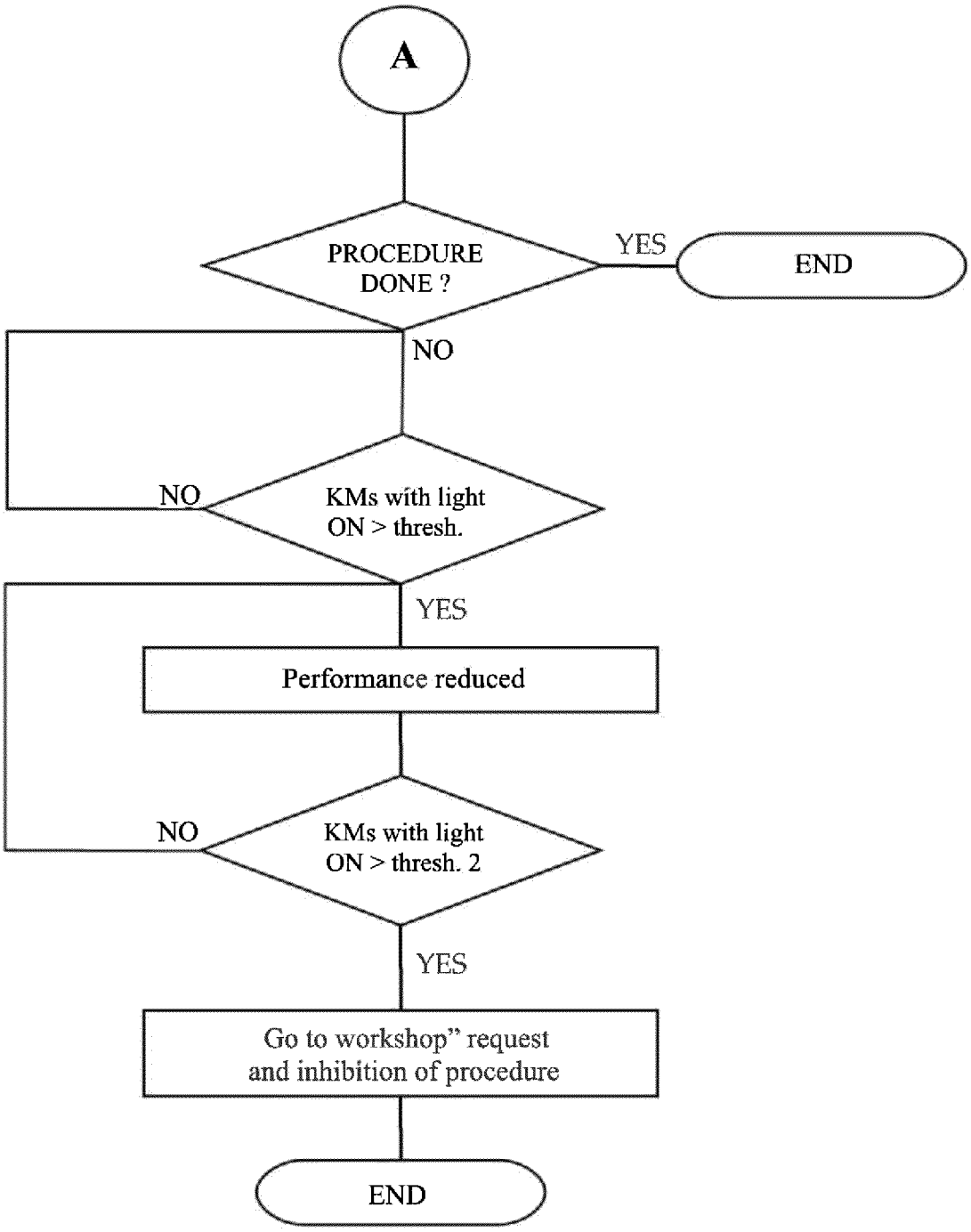

With reference to FIG. 4, the system is moreover programmed for checking that the driver activates manual regeneration before the vehicle has reached a certain mileage since the alarm condition was last generated, with inhibition of the automatic regeneration mode. In the case of the example illustrated in FIG. 4, two successive thresholds of the distance covered by the vehicle are envisaged. In the case where the manual-regeneration procedure has not been executed when the first threshold value reaches the above distance the vehicle enters a state of limitation of performance in order to induce the driver to perform the manuals regeneration strategy. If also this condition is ignored and the second threshold value for the distance covered is reached, a warning signal for engine breakdown is activated, and the possibility for the driver to activate manual regeneration is inhibited. The procedure can in this condition be executed only at a repair shop.

In order to execute the manual procedure, the following conditions are preferably necessary:

vehicle stationary and brakes on;

engine in steady running conditions;

presence of a request for manual regeneration by the driver (for example, by pressing a dedicated pushbutton, or else by activating the accelerator pedal and brake pedal according to a pre-set modality).

After activation of the manual regeneration mode, said regeneration is executed within a time of approximately 15 minutes. At the end of manual regeneration, the automatic regeneration mode is re-enabled, with return to normal operating conditions, in which the particulate can once again accumulate in the filter. The counter of unfavorable events is of course reset.

Of course, without prejudice to the principle of the invention, the details of construction and the embodiments may vary widely with respect to what has been described and illustrated herein purely by way of example, without thereby departing from the scope of the present invention.

What is claimed is:

1. A diesel engine, comprising:

a particulate filter set in an exhaust line of the engine, and an electronic control unit for controlling fuel injectors associated to cylinders of the engine, said control unit programmed for activating—when an amount of particulate accumulated in said filter higher than a particulate threshold value is detected or estimated —a modality of control of the injectors that causes an automatic regeneration of the filter by an increase in a temperature of exhaust gases sent to the filter sufficient for burning the particulate in the filter;

the electronic control unit programmed for activating an alarm condition and inhibiting the automatic regeneration mode and enabling simultaneously an on-demand regeneration mode activatable manually by a driver when said electronic control unit detects an oil value lower than a pre-set threshold of a parameter identifying a quality of the engine lubricating oil, the parameter calculated by a pre-set algorithm identifying the quality of the oil;

a manual control actuator for activation of the on-demand regeneration mode;

said electronic control unit programmed for activating said alarm condition when said electronic control unit detects;

an exceedance of a pre-set event threshold value of a number of unfavorable events in which the automatic regeneration mode is interrupted before a completion of the automatic regeneration of the filter;

said electronic control unit programmed in such a way that, in a case of detection of the number of unfavorable events higher than the event threshold value, the alarm condition with inhibition of the automatic regeneration mode and enabling of the on-demand regeneration mode is activated only in the case where the electronic control unit also detects a resistance to a flow of the exhaust gases through the particulate filter higher than a resistance threshold value.

2. The engine according to claim 1, further comprising a sensor for detecting the difference in pressure between upstream and downstream of the particulate filter, said difference in pressure being used as parameter identifying the resistance to the flow of the exhaust gases by the electronic control unit.

3. The engine according to claim 1, wherein the quality of the engine lubricating oil is calculated by the algorithm on the basis of the value of the parameter identifying the quality of the oil on the basis of a signal output from an oil-viscosity sensor.

4. The engine according to claim 1, wherein the electronic control unit is programmed for controlling such that after activation of the alarm condition, inhibition of the automatic regeneration mode and enabling of the manual regeneration mode, manual regeneration is performed before the vehicle has covered a pre-set distance from when the alarm condition has been activated.

5. The engine according to claim 4, further comprising two successive threshold values of the distance covered by the vehicle after activation of the alarm condition, and the electronic control unit programmed for setting the vehicle in a condition of limited performance when the first threshold value is reached and for inhibiting the possibility of manual regeneration and signalling to the driver the need for the procedure of regeneration to be executed in a repair shop when the second threshold value is reached.

6. The engine according to claim 1, wherein the electronic control unit is programmed for starting manual regeneration in the presence of all the following conditions:

vehicle stationary and brakes on;

engine functioning and in steady running conditions; and request for manual regeneration by the user.

7. The engine according to claim 1, wherein the means for manual control of regeneration of the particulate filter comprise a dedicated pushbutton.

8. The engine according to claim 1, wherein the electronic control unit is programmed for starting on-demand regeneration of the particulate filter in the case where the accelerator and brake pedals are activated according to a pre-set modality.

9. A method for controlling a diesel engine comprising:

employing a particulate filter set in an exhaust line of the engine, and an electronic control unit configured to control fuel injectors associated to cylinders of the engine;

activating, via the electronic control unit—when an amount of particulate accumulated in said filter higher than a particulate threshold value is detected or estimated—a modality of control of the injectors that causes an automatic regeneration of the filter by of an increase in a temperature of the exhaust gases sent to the filter sufficient for burning the particulate in the filter, activating an alarm and inhibiting the automatic regeneration mode and simultaneously enabling an on-demand regeneration mode activatable manually by a driver when said electronic control unit detects an oil value lower than a pre-set threshold of a parameter identifying a quality of the engine lubricating oil:

activating said alarm condition when said electronic control unit detects exceeding of a pre-set threshold value of the number of unfavorable events;

and a value lower than a pre-set threshold of a parameter identifying the quality of engine lubricating oil.

10. The method according to claim 9, further comprising calculating the quality of the engine lubricating oil by a pre-set algorithm on the basis of the value of a parameter identifying the quality of the oil, for example, on the basis of the signal at output from an oil-viscosity sensor.

11. The method according to claim 10, wherein after activation of the alarm condition—with inhibition of the automatic regeneration mode and enabling of the manual regeneration mode—further comprising performing a check to verify whether manual regeneration is performed before the vehicle has covered a pre-set distance since the alarm condition was activated.

12. The method according to claim 11, wherein two successive threshold values of the distance covered by the vehicle after activation of the alarm condition are set, and further comprising the vehicle being set in a condition of limited performance when the first threshold value is reached, and inhibiting the possibility of manual regeneration and warning the driver of the need for the procedure of regeneration to be executed in a repair shop when the second threshold value is reached.

13. The method according to claim 9, wherein the electronic control unit starts manual regeneration in the presence of all of the following conditions:

vehicle stationary and brakes on;

engine functioning and in steady running conditions; and request for manual regeneration by the user.

* * * * *